United States Patent [19]

Kriedt et al.

[11] Patent Number: 4,965,510

[45] Date of Patent: Oct. 23, 1990

[54] INTEGRATED SEMICONDUCTOR CIRCUIT

[75] Inventors: Hans Kriedt, München; Andreas Dietze, Valley-Grub; Josef Fenk, Eching, all of Fed. Rep. of Germany

[73] Assignee: Siemens Aktiengesellschaft, Munich, Fed. Rep. of Germany

[21] Appl. No.: 298,868

[22] Filed: Jan. 17, 1989

Related U.S. Application Data

[63] Continuation of Ser. No. 806,140, Dec. 5, 1985, abandoned, which is a continuation of Ser. No. 724,942, Apr. 18, 1985, abandoned, which is a continuation of Ser. No. 416,018, Sep. 8, 1982, abandoned.

[30] Foreign Application Priority Data

Sep. 16, 1981 [DE] Fed. Rep. of Germany ..... 3136780

[51] Int. Cl.[5] ..... G05F 3/16

[52] U.S. Cl. ..... 323/315; 323/316; 307/296.6; 330/288

[58] Field of Search ..... 307/296.1, 296.6; 323/312, 315, 316, 317; 330/288

[56] References Cited

U.S. PATENT DOCUMENTS

| | | | |
|---|---|---|---|
| 3,962,592 | 6/1979 | Thommen et al. | 323/315 |
| 4,251,743 | 2/1981 | Hareyama | 307/296 R |
| 4,399,399 | 8/1983 | Joseph | 323/315 |
| 4,475,077 | 10/1984 | Nagano | 323/312 |

FOREIGN PATENT DOCUMENTS

| | | | |
|---|---|---|---|
| 3146600 | 7/1983 | Fed. Rep. of Germany | 323/315 |
| 71312 | 6/1981 | Japan | 330/288 |
| 101310 | 6/1983 | Japan | 323/315 |

OTHER PUBLICATIONS

Kessel; "Integrierbare Grundschaltungen"; Philip's Review, vol. 32 No. 1, (1971/1972) pp. 4–8.

*Primary Examiner*—Steven L. Stephan
*Assistant Examiner*—Jeffrey Sterrett
*Attorney, Agent, or Firm*—Herbert L. Lerner; Laurence A. Greenberg

[57] ABSTRACT

Integrated semiconductor circuit, including a control loop including a first current source acting as an actual value transmitter for the control loop, and a final control element acting on the first current source as a control, the first current source being in the form of a current mirror having a plurality of transistors each forming an output part driving a respective load element, and a second constant current source being independent of the first current source and acting as a desired value transmitter for the control loop.

1 Claim, 2 Drawing Sheets

INTEGRATED SEMICONDUCTOR CIRCUIT

This application is a continuation, of application Ser. No. 806,140, filed Dec. 5, 1985, now abandoned.

BACKGROUND AND FIELD OF THE INVENTION

The invention relates to an integrated semiconductor circuit with a current source which is constructed as a current mirror and has several output parts which each serve for driving one load element and are each represented by a transistor.

PRIOR ART OF THE INVENTION

Current sources of this kind described for instance in "Philips Technische Rundschau" (Philips's Review)32 (1971/72) No. 1, pp. 4–8. It is the purpose of such current sources to supply a current which is independent of the voltage present at the current source, as far as possible. It is further meant to control the magnitude of the current delivered, which can be done, for instance, by means of a reference current. Besides simple current source circuits, there are also current sources with a current mirror formed of npn-transistors combined with a current mirror formed of pnp transistors.

However, it has been observed in these devices that factors such as variations in gain of individual output transistors of the current mirror, and differences in magnitudes of currents present at the outputs of the current sources due to heavier base current loading of the current source transistors, are unavoidable. These disadvantages will be discussed in more detail below with respect to FIGS. 1 and 2.

SUMMARY OF THE INVENTION

It is accordingly an object of the invention to provide an integrated semiconductor circuit, which overcomes the hereinaforementioned disadvantages of the heretofore-known devices of this general type, to compensate the effect of such deviations on the currents delivered by the current source, and to improve the independence of the currents delivered to the load of the current source.

With the foregoing and other objects in view there is provided, in accordance with the invention, an integrated semiconductor circuit, comprising a control loop including a first current source acting as an actual value transmitter for the control loop, and a final control element responding to the first current source as a control, the first current source being in the form of a current mirror having a plurality of transistors each forming an output part driving a respective load element, and a second constant current source being independent of the first current source and acting as a desired value transmitter for the control loop or circuit.

In accordance with another feature of the invention, the second constant current source is also in the form of a current mirror.

In accordance with a further feature of the invention, the current mirror of the first current source to be controlled includes first and second transistors of a given conductivity type having emitter-collector paths, the first transistor of the current mirror being connected as a diode, and the second transistor not being connected as a diode, and the desired value transmitter includes a current mirror having third and fourth transistors of a conductivity being opposite the given type and having emitter-collector paths, the third transistor of the current mirror of the desired value transmitter being connected as a diode, the fourth transistor not being connected as a diode, the collector-emitter paths of the first and fourth transistors being connected together in series, and the collector-emitter paths of the second and third transistors being connected together in series.

In accordance with an added feature of the invention, the actual value transmitter includes two mutually complementary current mirrors each having transistors with base terminals connected to each other, and the final control element is a control amplifier in the form of a differential amplifier having an output directly connected to the base terminals of one of the mutually complimentary current mirrors of the actual value transmitter.

In accordance with an additional feature of the invention, there are provided two supply potential sources, the desired value transmitter including a transistor connected as a diode in series with the second constant current source forming series circuit with a divider point connected therebetween and two ends each being connected to a respective one of the supply potential sources, the control amplifier having an input connected to the divider point.

In accordance with again another feature of the invention, there are provided two supply potential sources, and a control amplifier having two inputs, the current mirror forming the second constant current source and the desired value transmitter having an output connected to one of the inputs of the control amplifier and to one of the supply potential sources.

In accordance with again a further feature of the invention, there is provided a resistor connected between the output of the current mirror forming the second constant current source, and the one supply potential source.

In accordance with again an added feature of the invention, the current mirror forming the first current source to be controlled includes an input transistor being connected as a diode and having an input electrode connected to the other of the supply potential sources delivering a reference potential, a third current source connected to the one supply potential source, and a circuit point being connected to the other of the inputs of the control amplifier and being further connected between the input transistor and the third current source.

In accordance with again an additional feature of the invention, the current mirror forming the first current source to be controlled includes an output transistor and includes current input electrodes connected to the other of the supply potential sources delivering a reference potential, another load element connected to the one supply potential source, and a circuit point being connected to the other input of the control amplifier and being connected between the output transistor and the other load element.

In accordance with yet another feature of the invention, the current mirror forming the first current source to be controlled includes an input transistor having a collector and a base connected to the final control element.

In accordance with a concomitant feature of the invention, the transistors are bipolar transistors, such as npn-transistors.

A circuit corresponding to the definition given initially herein is therefore constructed according to the invention, in such a way that an unloaded current source circuit serves as a reference-value transmitter for a control loop which controls the second, loaded current source.

Other features which are considered as characteristic for the invention are set forth in the appended claims.

Although the invention is illustrated and described herein as embodied in an integrated semiconductor circuit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
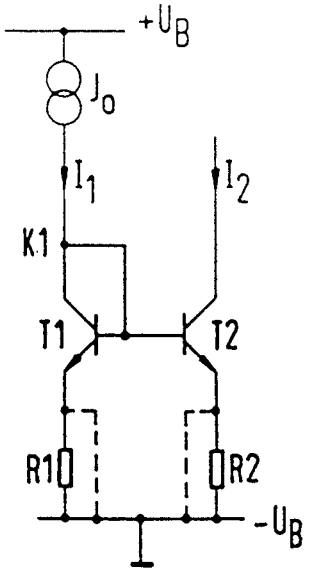
FIG 1 PRIOR ART
FIG. 1 is a schematic circuit diagram of a simple prior art current mirror.
Figure 2:
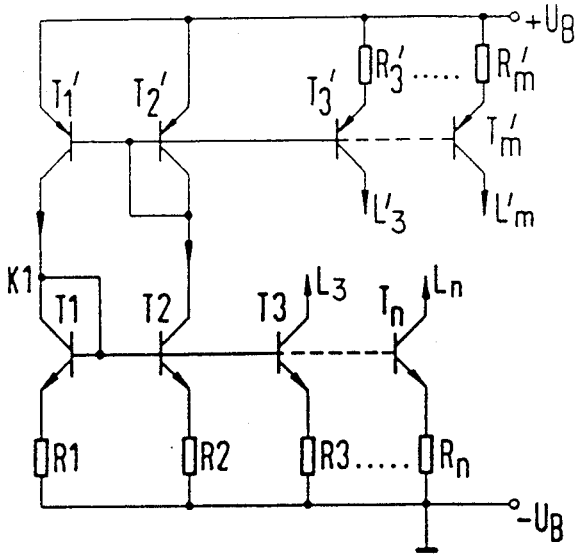
FIG 2 PRIOR ART
FIG. 2 is a circuit diagram of a prior art current source including a current mirror formed of npn transistors and a current mirror formed of pnp transistors.

Referring now to the figures of the drawing and first particularly to FIGS. 1 and 2 thereof, it is seen that several transistors of the same conductivity type can be provided as one output for each current source. These transistors are then connected jointly to a transistor of the same type, which is connected as a diode through its control electrodes, and in turn the transistors are each provided as the current source for a load element L. It should finally be noted that such current mirror constant-current sources can be constructed in bipolar technology as well as in MOS technology.

DESCRIPTION OF THE PREFERRED EMBODIMENTS

In the circuit shown in FIG. 1 for such a constant-current source, there are two supply terminals $+U_B$ and $-U_B$, one of which, being the terminal $-U_B$ in the example shown, is grounded, i.e. , it is used as a reference potential connection. Two npn-transistors T1 and T2 are connected together through their base terminals, and the collector of the transistor T1 is also connected to the base of transistors T1 and T2. Due to this connection, the transistor T1 acts as a diode and can therefore be replaced, if desired, by a diode. The emitters of the two npn-transistors T1 and T2 are connected either directly or through a respective resistor R1 or R2 to the reference potential $-U_B$.

With reference to FIG. 1, the following can now be said: if a current $I_1$ is fed into the nodal point K1, a proportional current $I_2$ flows into the collector of the transistor T2, depending on the size of the emitter area of transistor T2 and the resistor R2. If the constant-current source is constructed in accordance with FIG. 2, the combination of the transistors T1 and T2 shown in FIG. 1 is supplemented by a complimentary arrangement of transistors of the other conduction type, so that the collector of the transistor $T_1'$ is connected as the current source of the current $I_1$ for the transistor T1 at the nodal point K1. The base terminals of the pnp-transistors $T_1'$ and $T_2'$ are tied to the collector of the transistor $T_2'$ and are connected to the collector of the npn-transistor T2., The emitters of the pnp-transistors $T_1'$ and $T_2'$ are connected to the supply potential $+U_B$ either directly or through resistors. If the resistor R1 which connects the emitter of the npn-transistor T2 to the reference potential $-U_B$ is replaced by a short circuit, and if the npn-transistor T2 has an n-times larger emitter area, a PTC current source which is also known, is obtained (PTC refers to a positive temperature current source).

The loads $L_3 \ldots L_n$ and $L_3' \ldots L_m'$ shown in FIG. 2 are supplied by the current source transistors $T_3 \ldots T_n$, the base potentials of which are identical with the base potentials of the npn-transistors T1 and T2 and the pnp-transistors $T_1'$ and $T_2'$.

The advantage of utilizing a circuit according to FIG. 2 as the power supply of an integrated circuit which is combined monolithically with the current source, is that the circuit is also operable at supply voltages $U_B \leqq 1.5$ V, which is not assured in normal current-mirror current derived from constant-current sources. In addition, this circuit has a positive temperature coefficient which is advantageous for many applications.

According to experience, the known current sources of the current-mirror type such as are shown in FIGS. 1 and 2, and which simultaneously have several output transistors $T_3, \ldots T_n$ or $T_3' \ldots T_m'$ controlled by a reference current $I_1$, are characterized by the feature that upon heavier, loading by the base currents of the transistors $T_3 \ldots T_n$ and $T_3' \ldots T_m'$, a noticeable influence on the magnitude of the currents delivered at the individual outputs of the current sources takes place. Since furthermore, due to production factors, different current gain factors of the individual output transistors of the current mirror are unavoidable and these differences are noticeable as differences in the base currents of these transistors, an influence on the currents delivered at the outputs of the constant-current source resulting therefrom is likewise unavoidable in the known circuits.

The embodiment of the invention corresponding to FIG. 1 is shown and described with reference to FIG. 3, and the embodiment corresponding to FIG. 2 is shown and described with reference to FIG. 4.

Figure 3:
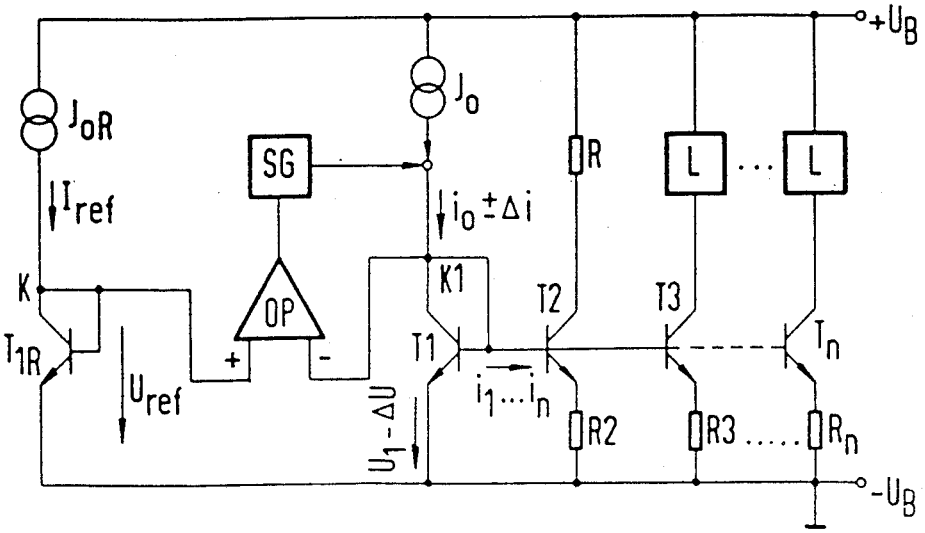
FIGS. 3 and 4 are circuit diagrams of embodiments of the invention, corresponding to FIGS. 1 and 2, respectively.

Considering the type of circuit according to the invention which is shown in FIG. 3, the following can be stated: due to the current from current sources $J_{oR}$ and $J_o$, voltages $U_{ref}$ and $U_1$ appear at transistors $T_{1R}$ and T1 connected as diodes. If there are many transistors T2, T3, . . .$T_n$, a base current $\Sigma i = i_1 + i_2 + i_3 \ldots + i_n$, which is no longer negligible, is drawn off. This leads to an error voltage $U_1$-$\Delta U$. A control amplifier OP measures this quantity and makes the sum current $\Sigma i$ available through a final control element SG. A residual deviation according to the control gain remains.

In the embodiment according to FIG. 3, a nodal point K is provided which is connected between the reference current source $J_{oR}$ and a diode connected in the forward direction, and formed by the npn-transistor $T_{1R}$. The nodal point K serves for addressing the direct input (+) of the control amplifier OP which serves as a comparator. The inverting input (−) of the control amplifier OP is connected to the nodal point K1 between transistor T1 and the current source $J_o$, which provides its drive potential. This drive potential is set by the final control element SG.

In a further improved embodiment of the invention, described hereinabove in connection with FIG. 3 and shown in FIG. 4, voltages $U_{ref}$ and $U_1$ are created by the current sources $J_{oR}$ and $J_o$ at the resistances r or R, respectively. If a no longer negligible base current-$\Sigma i = i_1 + i_2 + i_3 + \ldots + i_n$ is now drawn off at the transistors T1, $T_2 \ldots T_n$, an error deviation of $U_2 - \Delta U$ is obtained at the resistor R. The control amplifier OP measures this variable and makes the sum current $\Sigma i$ available through the final control element SG. In this case as well, there remains a residual deviation corresponding to the control gain.

Figure 4:
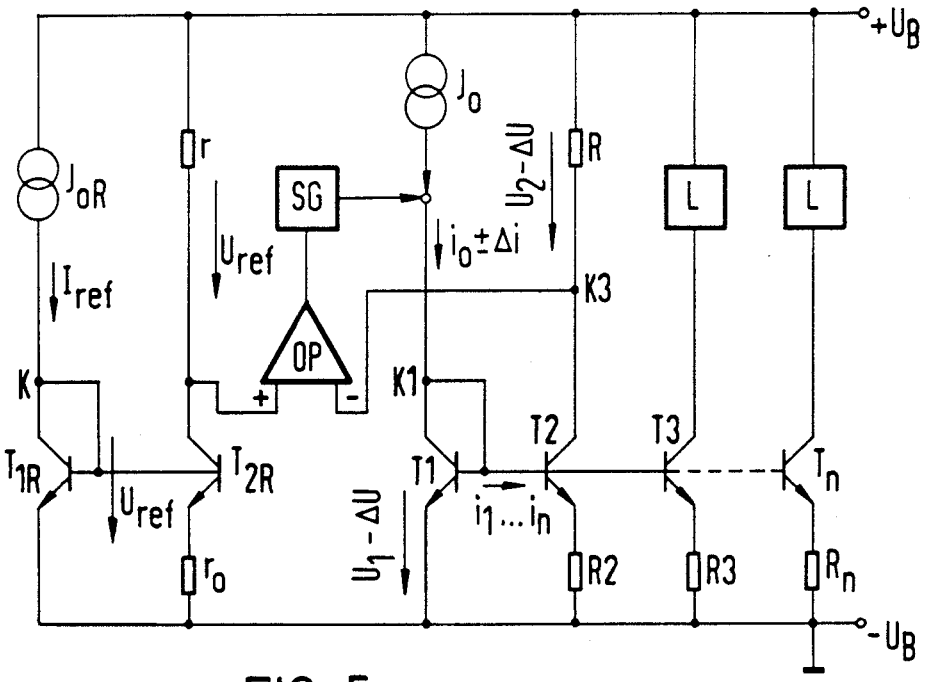

In the embodiment shown in FIG. 4, the reference current source $J_{oR}$ is similarly expanded to form a current mirror. For this purpose the nodal point K in the circuit according to FIG. 4 is not connected directly to the non-inverting input (+) of the control amplifier; OP as in the circuit according to FIG. 3, but is connected instead through an npn-transistor $T_{2R}$. It is therefore seen that the nodal point K is connected to the base of the transistor $T_{2R}$. The collector of the transistor $T_{2R}$ is connected on one hand through a resistor r to the supply potential $+U_B$ and on the other hand, to the non-inverting input (+) of the control amplifier OP. The emitter of the current mirror output transistor $T_{2R}$ is connected either directly or through a resistor $r_o$ to the reference potential $-U_B$ Deviating from the circuit according to FIG. 3, for addressing the other input of the control amplifier, the inverting input, a nodal point $K_3$ is provided, instead of the nodal point $K_1$, between the transistor T1 and the current source $J_o$. The nodal point $K_3$ is connected between the collector of the transistor T2 and a load resistor R connected to the supply potential $+U_B$ in the circuit according to FIG. 4. As in the circuit according to FIG. 3, the final control element SG controlled by the output of the control amplifier OP acts on the current flow to the input K1 of the current mirror to be controlled.

Figure 5:
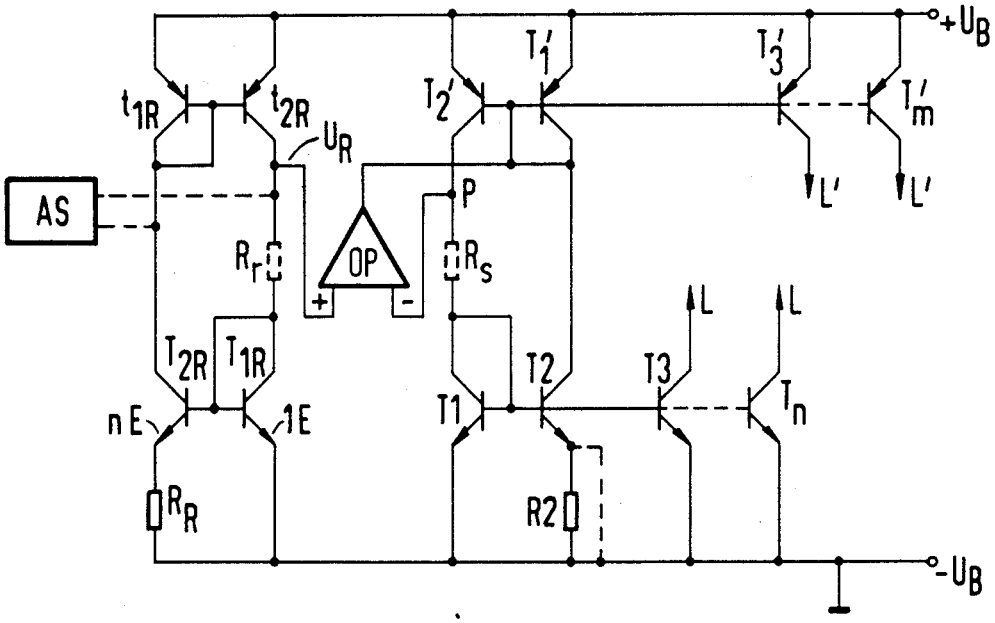
FIG. 5 is a circuit diagram of another embodiment of the invention having a combination of two current sources.

The embodiment according to FIG. 5 is derived from the structure of the complementary constant-current source T1, T2, T140 , $T_2'$ shown in FIG. 2. According to the invention, a reference circuit including two mutually complementary current mirrors is provided as the desired-value transmitter in the form of a so-called "PTC" system. The PTC system includes two npn-transistors $T_{1R}$ and $T_{2R}$ combined to form an npn-current mirror and two pnp-transistors $t_{1R}$ and $t_{2R}$, which are combined to form a pnp-current mirror and are connected to each other and to the two supply terminals $+U_B$ and $-U_B$, as also shown in FIG. 2. A circuit point $U_R$ serves to provide the potential biasing the non-inverting input (+) of the control amplifier OP. The circuit point $U_R$ is disposed between the npn-transistor $T_{1R}$ connected as a diode, and the pnp-transistor $t_{2R}$ which is not connected as a diode. Between the above-mentioned circuit point $U_R$ and the npn-transistor $T_{1R}$ connected as a diode, a resistor $R_r$ shown in dashed lines which will be discussed in detail later on, may be further provided.

The inverting input (−) of the control amplifier OP is connected to a circuit point P between the npn-transistor T1, which is connected as a diode, and the pnp-transistor $T_2'$ which is not connected as a diode. The emitter-collector path of the pnp-transistor $T_2'$ is connected in series with the npn-transistor T1. Furthermore, in this embodiment a resistor $R_s$ shown in dashed lines corresponding to the resistor $R_r$ may be provided between the connecting point P of the branch leading to the control amplifier OP and the npn-transistor T1 connected as a diode.

In the circuit shown in FIG. 5, the combination of the two current mirrors T1, T2, and $T_1'$ and $T_2'$ serves as the actual-value transmitter as well as a control, wherein the driving point of the control is provided by the base terminals of the pnp-transistors $T_1'$ and $T_2'$, forming the pnp-current mirror.

Regarding the operation of the circuit of FIG. 5 the following applies: The threshold voltage of the npn-transistor $T_{1R}$ connected as a diode in the reference current mirror is compared with the threshold of the npn-transistor T1, connected as a diode, by means of the control amplifier OP. If it is found that the threshold of the transistor T1 is lower due to the base current load in the current source, i.e. in the transistors $T_3, \ldots T_n$ and $T_3', \ldots T_m'$. than that of the npn-transistor $T_{1R}$, then an additional current is fed into the base of the transistor $T_1'$ of the current source through the control amplifier OP, which operates as a differential current amplifier, and is mirrored through the pnp-transistor $T_2'$. This control process is carried out automatically until the threshold voltage of the npn-transistor T1, connected as a diode, is again as large as that of the npn-transitor $T_{1R}$, also connected as a diode, in the unloaded reference current source. The desired objective of cancelling a deviation of the currents flowing to the load elements L3–Ln and $L_3'L_m'$, respectively, through the transistors $T_2'$, $T_3', \ldots T_m'$ and T2, T3, $\ldots T_n$ of the current source, from the reference current flowing through the diode $T_{1R}$, is therefore achieved.

In FIG. 5 two further embodiments of the circuit are indicated with dashed lines:

1. Through the afore-mentioned introduction of the two resistors $R_r$ and $R_s$, which are made, for instance, of equal size, a steeper control and therefore an improved cancelling operation is achieved.

2. A simplification of the circuit can be achieved if the npn-current mirror is constructed as a 1:1 current mirror, which requires eliminating the resistor R in the main supply circuit, which is provided between the npn-transistor T2 and the supply potential $+U_B$. In addition, the ,transistor area step-down from T1 to T2 can also be eliminated.

3. A starting circuit AS having an output connected to one of the collectors of the two pnp-transistors $t_{1R}$ or $t_{2R}$ in the reference loop or circuit, can provide that start-up operation of the current stabilization for the outputs of the current source is assured.

With respect to FIG. 5, it should further be stated that the starting circuit AS is a circuit part constructed in the usual manner, which ensures that the required currents can build up in the reference value transmitter after the supply voltage $U_B$ is applied. For instance, the starting circuits AS may be formed of a resistor which forms a direct connection between the base of the npn-transistor $T_{1R}$ and the supply potential $+U_B$. It should further be noted that the desired-value current is determined by the ratio D of the emitter areas of the two transistors $T_{1R}$ and $T_{2R}$, which is on FIG. 5 by the references nE and 1E at the emitters of the transistors $T_{2R}$ and $T_{1R}$ , respectively.

Finally, in view of the control amplifier which is to be used in a circuit according to the invention, the following should further be stated. The control amplifier includes the operational amplifier OP (which among other things provides the function of a comparator for determining the control deviation) and the final control element SG driven by it. It is constructed in a known manner, in such a way that at the input of the control amplifier, a difference between the actual-value currents and the desired-value currents (optionally after converting the difference of the current values into a voltage difference) is taken off and is converted. This is done so that the actual-value current agrees with the desired-value current at the summing point of the actual-current source and the control amplifier output. In general, this involves customary measures in the construction of the control amplifier, so that further explanations in that regard can be dispensed with.

It should finally be mentioned, that in the embodiment example shown, pnp-transistors may be used instead of the npn-transistors, and the npn-transistors in lieu of the pnp-transistors, if the polarities of the supply potentials are changed accordingly. Instead of the bipolar transistors, MOS field-effect transistors of the self-locking (latching) type can also be used, such as by replacing the npn-transistors with n-channel-MOS-FET's and by replacing the pnp-transistors with p-channel-MOS-FET's, in the embodiment of the invention.

We claim:

1. Integrated semiconductor circuit, comprising a control loop including a first current source acting as an actual value transmitter for said control loop, and final control means acting on said actual value transmitter as a control, said actual value transmitter being in the form of a current mirror having a plurality of transistors each forming an output part driving a respective load element, and a second constant current source being independent of said first current source and acting as a desired value transmitter for said control loop, wherein said current mirror of said actual value transmitter and said desired value transmitter each include first and second transistors of a given conductivity type having emitter-collector paths, said first transistor of said current mirror being connected as a diode, and said desired value transmitter and said actual value transmitter each includes a current mirror having third and fourth transistors of a conductivity type being opposite said given type and having emitter-collector paths, said third transistor of said current mirror of said desired value transmitter and said actual value transmitter being connected as a diode, the collector-emitter paths of said first and fourth transistors being connected together in series, and the collector-emitter paths of said second and third transistors being connected together in series.

* * * * *